US006578243B1

(12) United States Patent
Hall

(10) Patent No.: US 6,578,243 B1
(45) Date of Patent: Jun. 17, 2003

(54) BAG CLAMP

(76) Inventor: Christopher I. Hall, 6550 Ponto Dr., Carlsbad, CA (US) 92024

( * ) Notice: Subject to any disclaimer, the term of this patent is extended or adjusted under 35 U.S.C. 154(b) by 0 days.

(21) Appl. No.: 10/164,341

(22) Filed: Jun. 7, 2002

(51) Int. Cl.[7] ..... A44B 21/00; B67B 7/00

(52) U.S. Cl. ..... 24/501; 24/30.5 R; 24/502; 24/543; 30/2; 30/294

(58) Field of Search ..... 24/501, 500, 30.5 R, 24/30.5 P, 502, 543; 30/2, 294

(56) References Cited

U.S. PATENT DOCUMENTS 381,265 A * 4/1888 Martens ..... 24/30.5 R
2,679,098 A * 5/1954 Deicken ..... 30/294
4,360,970 A * 11/1982 Ostroski et al. ..... 30/2
4,656,697 A * 4/1987 Naslund ..... 24/30.5 R
4,660,750 A * 4/1987 Blanchard ..... 24/501
4,711,031 A * 12/1987 Annello ..... 30/294
4,847,956 A * 7/1989 Levine ..... 24/30.5 R
5,007,171 A * 4/1991 Horning, Jr. ..... 30/294
5,457,858 A * 10/1995 Lin ..... 24/501
5,752,319 A * 5/1998 Su et al. ..... 30/2
6,105,217 A * 8/2000 Caradine et al. ..... 24/501

* cited by examiner

*Primary Examiner*—Victor Sakran
(74) *Attorney, Agent, or Firm*—Steven W. Webb

(57) ABSTRACT

An improved bag clamp and bag cutter is presented that is a non-obvious increase in capability over this inventor's previous bag clamp/cutter invention. The improved clamp possesses a stronger spring, an improved cutting blade with safety guard, a springboard button for pressing the blade firmly against a bag surface, and other improvements.

5 Claims, 4 Drawing Sheets

BAG CLAMP

BACKGROUND OF THE INVENTION

This invention relates to devices for use with bags of food, pet food, potting soil, and other bulk items. More particularly, this invention relates to devices used to close and open these types of bags.

A previous invention, U.S. Pat. No. 6,105,217, "Bag Clamp", was co-authored by this inventor, and this patent application is a set of improvements to that invention.

As covered in the cited patent application, modern polymer plastic bags are useful containers for bulk foods, bulk pet foods, and other loose, granular or small-sized items. The bags have the drawback that they are difficult to close properly once opened. They usually have smooth or slick surfaces which are difficult to grab with closure devices.

Polymer bags such as those under consideration here are often opened with the intention of closing and then re-opening then at a future time. Secure closure of the bag, to preserve product freshness for example, is necessary as is easy re-opening. Therefore, a bag closure device of this type should securely close the opened bag and be convenient to use to re-open. The previous invention by this inventor accomplished these goals by use of a strong spring to keep the device closed and by distributing the gripping force along the length of the device rather than concentrating it in the center of the device.

There are competing devices in use that also close polymer bags, but they largely fail to close and keep closed heavier bags. The competing devices tend to slip off of the bag surface easily and are much less useful.

In the cited patent, this inventor developed a device that could be made in a variety of sizes while retaining the generic characteristics of the invention. The small versions could be used for potato chip bags, popcorn bags, and the like, while the largest size would be capable of closing and re-opening larger bags of potting soil or pet food. The large device was strong enough to prevent spillage of product if a bag was knocked over, for example.

Opening polymer bags is also a problem, because they are usually tightly sealed to prevent product degradation while on store shelves. A method of quickly and predictably opening such bags is also desirable. Providing such a method prevents bag tearing, destruction of the bag, and spillage of bag contents while making bag closing and re-opening more straight-forward. The cited invention possessed features to aid consumers in opening polymer bags in an easy and safe manner, long with the above-described closure, clamping and reopening features.

INVENTION DISCLOSURE

The present invention is a set of improvements to the cited invention co-authored by this inventor. The additional features are non-obvious and confer additional, valuable, and useful capabilities to the cited invention.

In common with the cited invention, there is a clamp for closing and holding closed a polymer bag, consisting of a pair of opposed clamp members, where these clamp members can be moved from a closed to an open position by pressing on them with the hand. A hinge connects the two members and holds them closed with the aid of a spring. There is a sharp blade on the inside of the "top" member held underneath a blade guard and opposite a split anvil. The blade does not extend past the guard in its rest position. The blade guard rests movably on one end on a fixed rest and is fixedly attached on the other. The blade guard has a slit down its length that permits the blade to emerge when a springboard button that it is connected to is pressed by the user gripping the bag clamp.

By pressing the button with a thumb while gripping the device, the blade is pushed through the slot in the guard and can then engage a polymer bag and cut it. When the button is not being pressed, the blade is retracted behind the guard for safety reasons.

The blade itself is improved over the previous invention, possessing increased sharpness and an improved cutting angle for maximum cutting efficiency. This is possible because of the added safety for users conferred by the blade guard.

The anvil of the previous invention is now a split anvil, with two parallel sides between which the blade fits and is guided. These changes to the previous invention are non-obvious safety improvements. The split anvil also holds bag material up to allow the blade to more easily penetrate the bag. When the blade is pressed through the guard, the guard itself is held against the split anvil, and the blade never contacts the anvil.

There are a set of ribs on the inside of each clamp member, configured so that the rib ridges on opposite sides meet when the clamp is closed. These ribs are designed to aid holding the bag when the clamp is closed. The ribs have an additional effect of stretching the bag material so that the blade can be more effective in cutting. The ribs also distribute the gripping force away from the hinge spring location.

The clip mouth ends also meet (the "lips"), and allow the bag to be drawn through the clip during the cutting process. There is in this improved invention an additional "tooth" in the middle of the bag "lips". The improved spring is now strong enough to hold larger bags than before.

BRIEF DESCRIPTION OF THE DRAWINGS

The construction and operation of the invention can be readily appreciated from inspection of the drawings that accompany this application, combined with the detailed specification to follow.

DETAILED DESCRIPTION OF THE INVENTION

Figure 2:
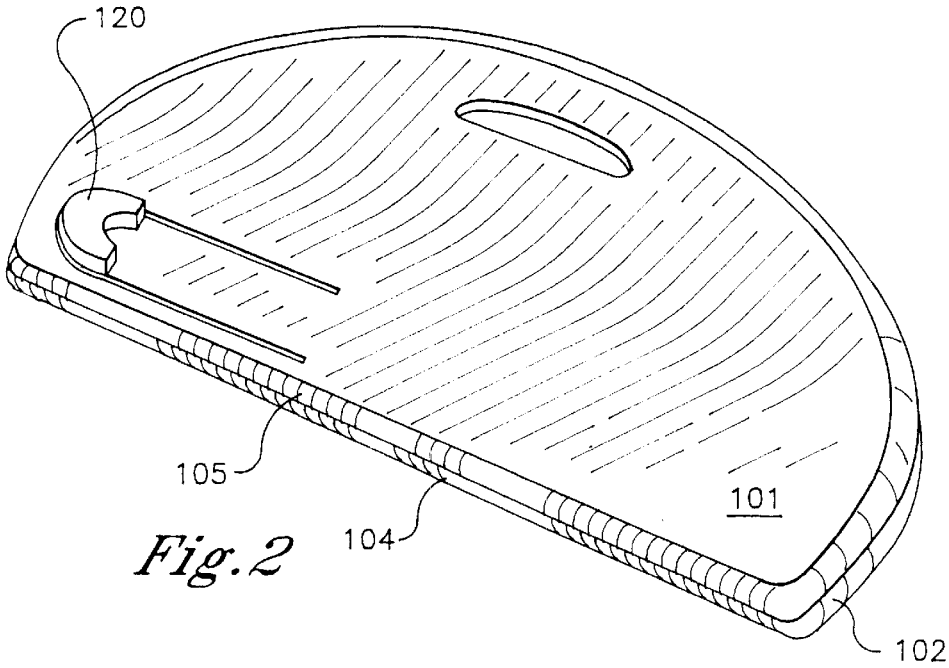
FIG. 2 is perspective view of the invention from the top.
Figure 3:
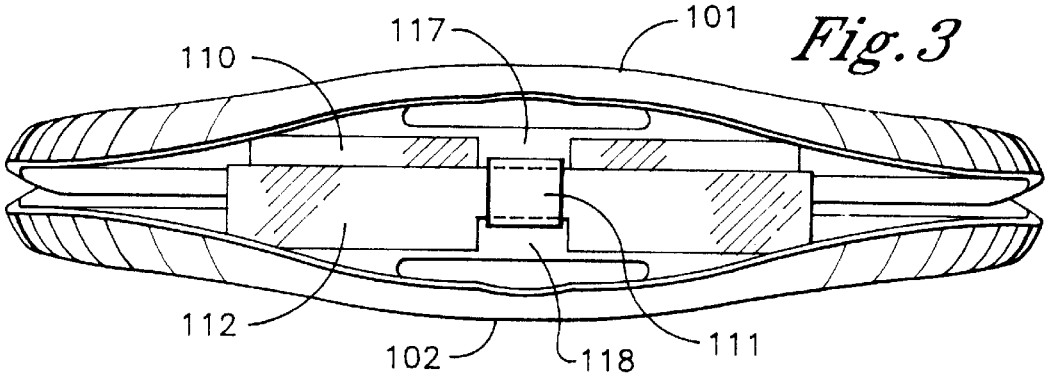
FIG. 3 is a side view of the invention from the grasping end

The present invention is an improved clamp for safely opening, clamping, and resealing polymer plastic storage bags. As shown in FIG. 2 and FIG. 3, the improved bag clamp[100] is comprised of an upper clamp member[101] and a lower clamp member[102] that are separated from each other as shown, the separation defining an opening[103] through which a polymer bag can be drawn. The upper[101] and lower[102] members each include a lip[104,105] that guides the polymer bag into the improved bag clamp opening[103].

The upper and lower clamp members each possess a leading end portion[106,107] for receiving the polymer bag. These end portions terminate in curved receptor edges[108,109]. The outer surface of each of the clamp members[101,102] is smooth.

An open box-like structure[112], having a slot[113], is disposed on the inner surface of the lower clamp member[102]. An elongated member[110], fixedly attached to the inner surface of the upper clamp member, is accepted in the slot[113] for rotational movement within the slot. As shown in FIG. 3, a spring clip[111] joins the clamp members[101,102] together and biases the mouth ends of the device together. The spring clip[111] possesses a pair of legs that are inserted through the sleeves[117,118] on the inner surfaces of the upper[101] and lower[102] clamp members.

Figure 4:
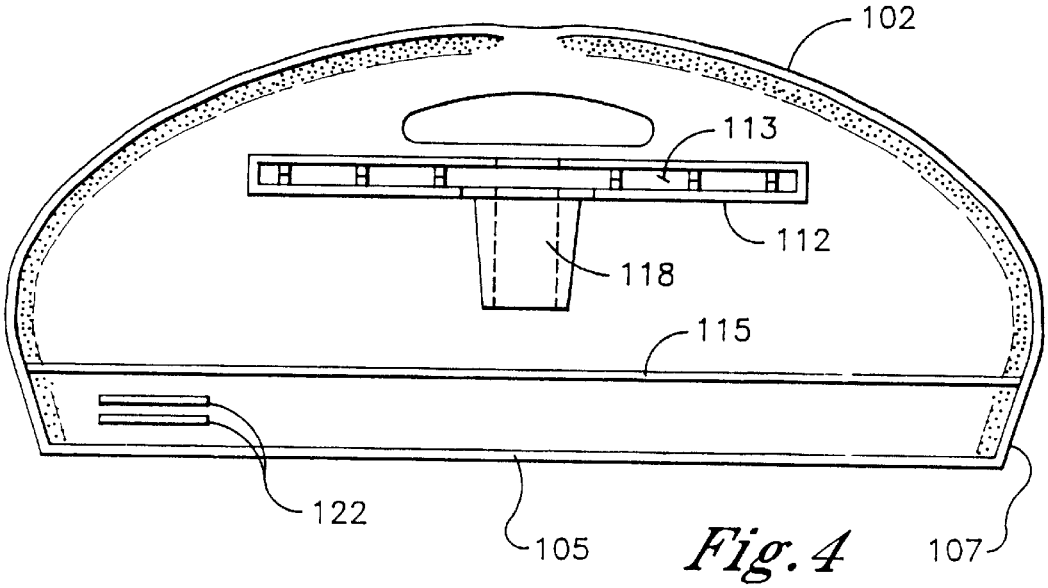
FIG. 4 is view of the inner surface of the bottom member
Figure 6:
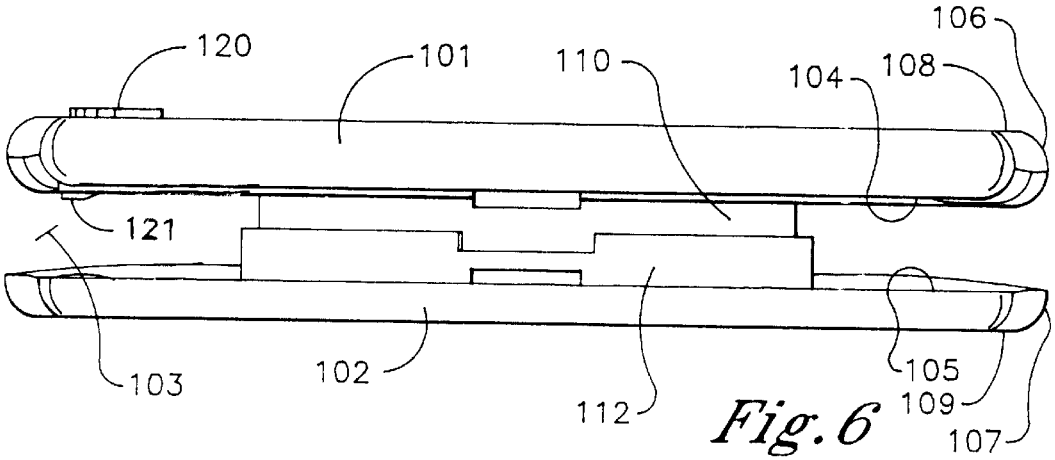
FIG. 6 is a side view of the invention looking at the mouth end with the clamp members held open
Figure 5:
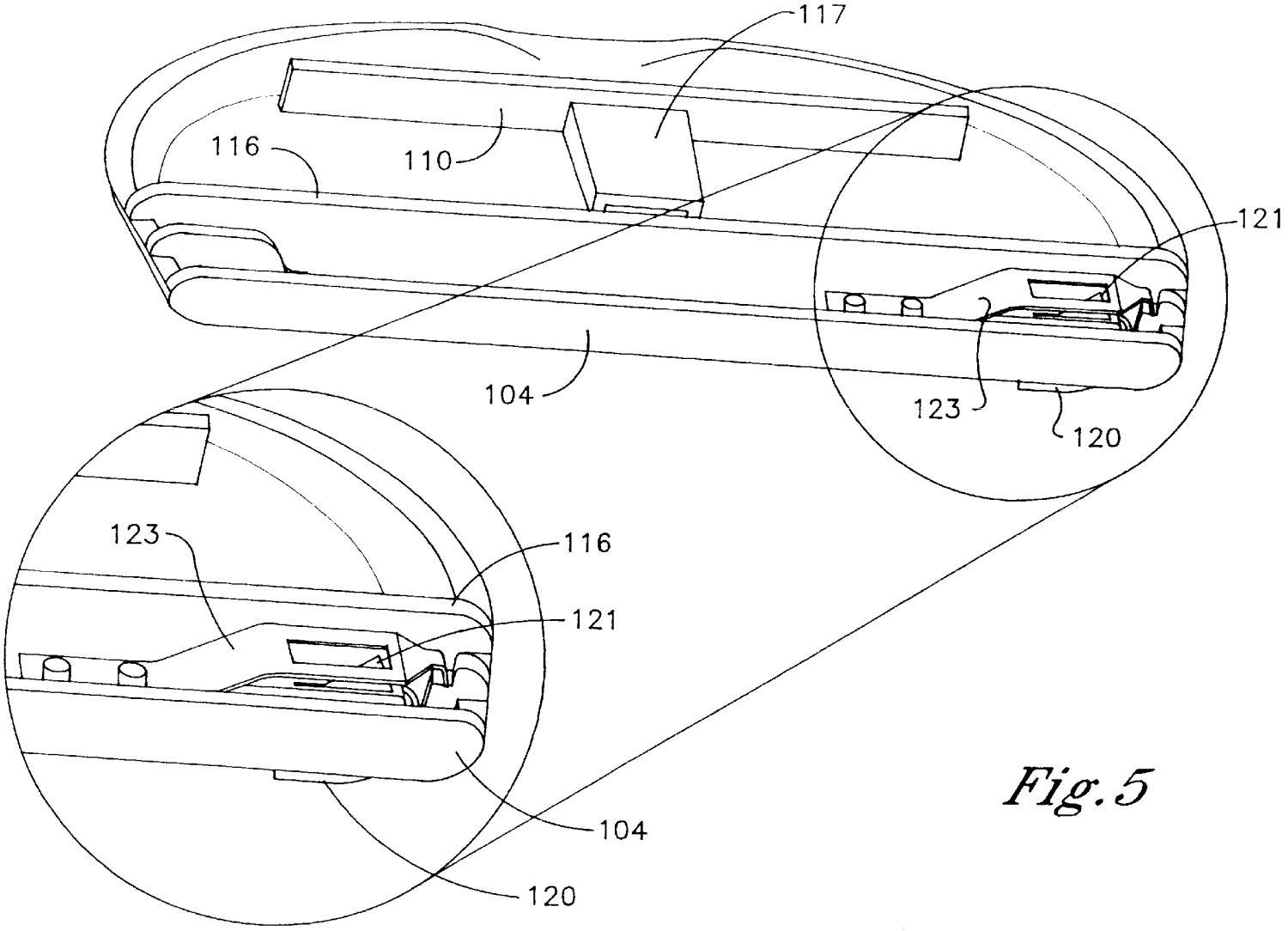
FIG. 5 is a view of the inner surface of the top member
Figure 7:
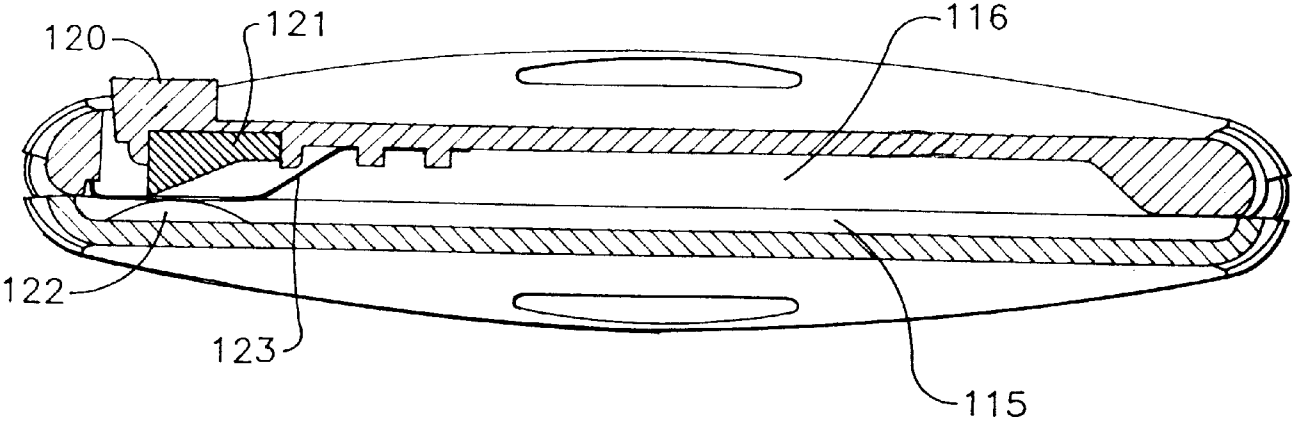
FIG. 7 is a cross-section diagram of the invention looking at the mouth end

Referring now to FIG. 4, It will be noted that on the inner surface of the "lower" clamp member[102], a raised rib[115] is placed parallel to the mouth end of the clamp member[102]. In FIG. 5, this rib is matched on the "upper" member by a similar rib[116], disposed such that when the clamp members[101,102] are biased closed by the spring clip[111], the ribs contact each other.

Figure 8:
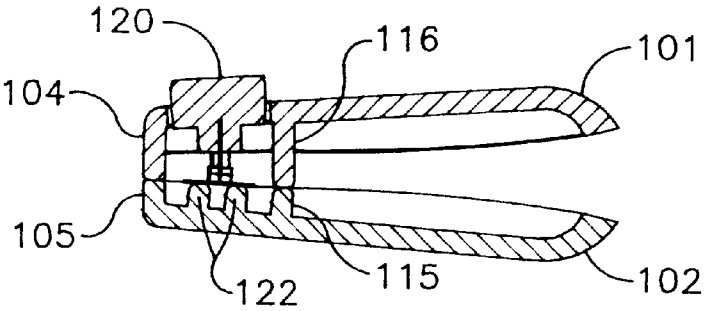
FIG. 8 is a cross section diagram of the invention looking at it from either side

Referring to FIG. 8, it can be seen that the clamp members meet at the mouth ends of the clamp members[104,105] and at the internal ribs[115,116] inside the clamp members. The spring pressure holds the polymer bag closed at these points. Note that a blade is not used to help keep a clamped bag closed, unlike in the cited invention, where a blade is continuously pressed against a flat anvil to help grip the bag.

Figure 1:
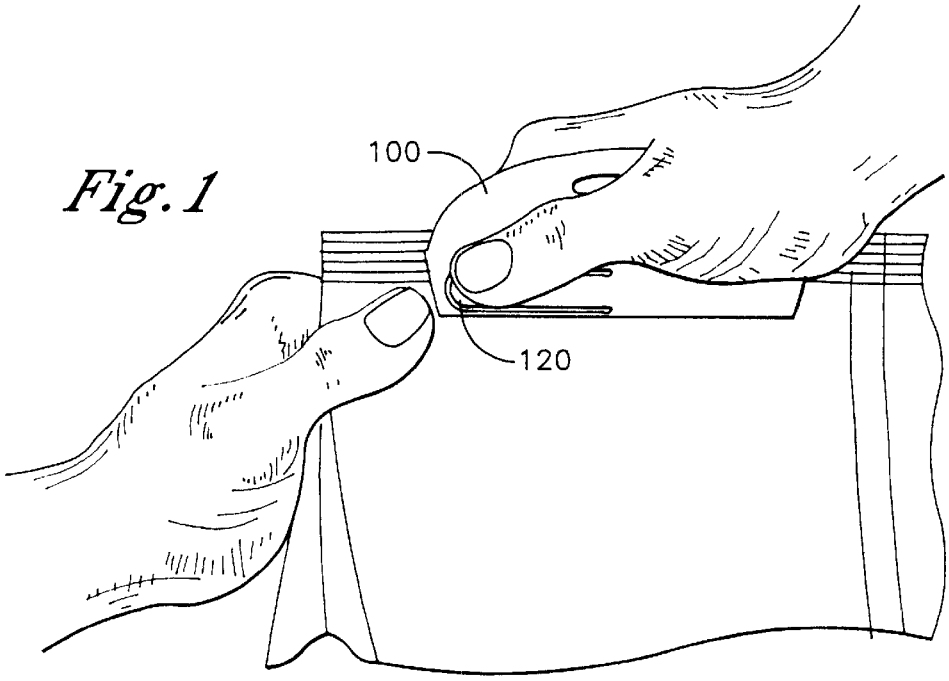
FIG. 1 is an overview drawing of the user grasping/cutting a bag with the invention.

In order to clamp the polymer bag closed, the user begins by grasping the bag with one hand as in FIG. 1. With the other hand, the user separates the clamp members[101,102] by squeezing the grasping ends of the invention and biasing the clamp[100] to an open position. The user then slides the open edges of the invention until the top of the polymer bag abuts the internal structure[112]. The user then relaxes the hand pressure on the grasping ends of the invention and allows the internal spring[111] to bias the clamp to a closed position. The pressure of the spring is now applied to the surface of the bag on both sides of the bag by the internal ribs[115,116] and the mouth ends of the clamp members[104,105].

The polymer bag can be released quickly from the clamp by squeezing the grasping ends of the clamp members while simultaneously removing the bag.

To slice open the polymer bag, the user grasps the clamp grasping ends and squeezes, as in the process to clamp the bag. The user then places the clamp over the bag is if to clamp it, as described above. The user then presses on the springboard button[120] to press the blade[121] into contact with the bag and push the blade through the bag, where it stops between the guides of the split anvil[122].

The leading edges of the mouth end of the clamp[106,107], the edges away from the springboard button, have a radiused corner[108,109] to help guide the clamp over seams in the polymer bag. The user then draws the clamp across the bag top in the direction of the other edge of the bag while keeping continuous pressure on the springboard button[120]. When the bag is completely open, the springboard button[120] is released and the blade retracts behind the blade guard[123] for safety.

It is evident that there are additional embodiments and applications of the improved bag clamp invention which are not disclosed in this detailed description, but which would clearly fall with the scope of said invention. This specification is intended to illustrate and clarify the nature of this invention and not limit its scope.

What is claimed is:

1. A improved bag clamp for closing and cutting a polymer bag, said clamp comprising:

two opposed clamp members, wherein said clamp members are movable between a closed and open condition, each one of said clamp members having an inner and an outer surface, a gripping means disposed on the inner surface of each one of said clamp members for gripping said bag, said gripping means including a plurality of internal ridges disposed on the inner surface of each one of said clamp members, each one of said clamp members possessing a mouth end for engagement of a bag surface and a grasping end for grasping by a user, a hinge attaching said clamp members to each other, said hinge attached to each clamp member inner surface at a location between said mouth end and said grasping end, the hinge biased by a spring clip, said spring clip possessing increased strength over spring clips in previous applications, each of said clamp member mouth ends possessing a lip for aiding in positioning said bag in said clamp, said clamp members identified as an upper clamp member and a lower clamp member, a cutting means disposed on the inner surface of said upper clamp member, said cutting means comprised of a cutting blade, a springboard button, and a blade guard, said cutting blade possessing a characteristic shape and increased sharpness such that cutting efficiency is improved over previous cutting blade designs for this application, a split anvil means disposed on the inner surface of said lower clamp member, said split anvil means disposed in such a manner that it is directly opposite said cutting means when said upper clamp member and said lower clamp member are in a closed position.

2. A clamp as in claim 1, where said springboard button is a piece of the upper clamp member, the piece flexibly attached to the remainder of the upper clamp member, the piece possessing an upper and a lower surface, said piece upper surface possessing concentric striations coincident with the upper surface of the upper clamp member.

3. A clamp as in claim 2, where the cutting blade is attached fixedly to said springboard button lower surface and coincident with the lower surface of the upper clamp member.

4. A clamp as in claim 3, where said blade guard is made of rigid material, the blade guard possessing a longitudinal slit, where the cutting blade is positioned such that when the springboard button is pressed by the user, the blade extends through the longitudinal slit.

5. A clamp as in claim 4, where said blade guard is made of flexible material, said blade guard attached movably at one end and fixedly at the other to said upper clamp member inner surface.

* * * * *